United States Patent [19]

Mizuno

[11] Patent Number: 4,475,504

[45] Date of Patent: Oct. 9, 1984

[54] METHOD AND APPARATUS FOR CONTROLLING THE IDLING SPEED OF AN INTERNAL COMBUSTION ENGINE

[75] Inventor: Kazuyoshi Mizuno, Susono, Japan

[73] Assignee: Toyota Jidosha Kogyo Kabushiki Kaisha, Toyota, Japan

[21] Appl. No.: 345,360

[22] Filed: Feb. 3, 1982

[30] Foreign Application Priority Data

Feb. 6, 1981 [JP] Japan ..... 56-15788

[51] Int. Cl.[3] ..... F02M 3/00

[52] U.S. Cl. ..... 123/339; 123/344

[58] Field of Search ..... 123/311, 339, 344, 585

[56] References Cited

U.S. PATENT DOCUMENTS

| | | | |
|---|---|---|---|
| 3,774,582 | 11/1973 | Masaki et al. | 123/339 |
| 4,240,145 | 12/1980 | Yano et al. | 123/585 |
| 4,321,900 | 3/1982 | Takeda | 123/339 |
| 4,344,399 | 8/1982 | Matsumura et al. | 123/339 |
| 4,345,557 | 8/1982 | Ikeura | 123/339 |
| 4,359,983 | 11/1982 | Carlson et al. | 123/339 |

*Primary Examiner*—Parshotam S. Lall
*Assistant Examiner*—W. R. Wolfe
*Attorney, Agent, or Firm*—Cushman, Darby & Cushman

[57] ABSTRACT

The flow rate of air passing through an air bypass passage which bypasses a throttle valve in an intake passage of an internal combustion engine during idling is corrected depending upon the atmospheric pressure around the engine. Thus, the idling speed of the engine can be stably controlled even at high altitudes.

12 Claims, 5 Drawing Figures

METHOD AND APPARATUS FOR CONTROLLING THE IDLING SPEED OF AN INTERNAL COMBUSTION ENGINE

BACKGROUND OF THE INVENTION

The present invention relates to a method and an apparatus for controlling the idling speed of an internal combustion engine.

A well-known method for controlling the speed of an engine when the throttle valve is at the idling position consists of providing an air-control valve in an air by-pass passage, which is connected in parallel with the intake passage of the internal combustion engine in order to by-pass the throttle valve in the intake passage, and adjusting the air-control valve to control the flow rate of the air that passes through the air bypass passage. In this closed loop type method of control, the air-control valve is adjusted to control the flow rate of the intake air in accordance with the difference between the desired idling speed of the engine and the actual idling speed of the engine so as to bring the actual idling speed close to the disired idling speed.

The conventional art, however, did not take into consideration atmospheric pressure in controlling the flow rate of the intake air. When an engine according to the conventional art is operated at high altitudes, therefore, its air-control valve does not adjust the actual idling speed as much as it should due to the reduced density of the intake air. When the amount of load applied to the engine by the air-conditioner, power-assisted steering, and/or transmission gear is further changed under such conditions, the actual idling speed of the engine deviates even more from the desired value, in the worst case, causing the engine to stall.

SUMMARY OF THE INVENTION

It is, therefore, an object of the present invention to provide a method and an apparatus for controlling the idling speed of an internal combustion engine, whereby said idling speed can be stably controlled even at high altitudes.

According to the present invention, the idling speed control method comprises the steps of: detecting the actual idling speed of the engine to produce a first electrical signal corresponding to said speed; detecting the atmospheric pressure surrounding the engine to produce a second electrical signal corresponding to said pressure; calculating, based on the first electrical signal, the difference between the actual idling speed and the desired idling speed; calculating the value of a control output signal from the calculated difference; correcting the calculated value of the control output signal according to the second electrical signal; and adjusting, based on the control output signal, the flow rate of air passing through an air bypass passage to control the actual idling speed so as to bring it close to the desired idling speed, said air bypass passage being connected with the intake passage of the engine at a position upstream of the throttle valve and with the intake passage at a position downstream of the throttle valve.

Furthermore, according to the present invention, an idling speed control apparatus is provided comprising: means for detecting the actual idling speed of the engine to produce a first electrical signal; corresponding to said speed; means for detecting the atmospheric pressure surrounding the engine to produce a second electrical signal corresponding to said pressure; processing means for (1) calculating, based on the first electrical signal, the difference between the actual idling speed of the engine and the desired idling speed, (2) calculating the value of a control output signal from the calculated difference, and (3) correcting the calculated value of the control output signal according to the detected second electrical signal; and means for adjusting, based on the control output signal, the flow rate of air passing through the air bypass passage to control the actual idling speed of the engine to bring it close to the desired idling speed.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
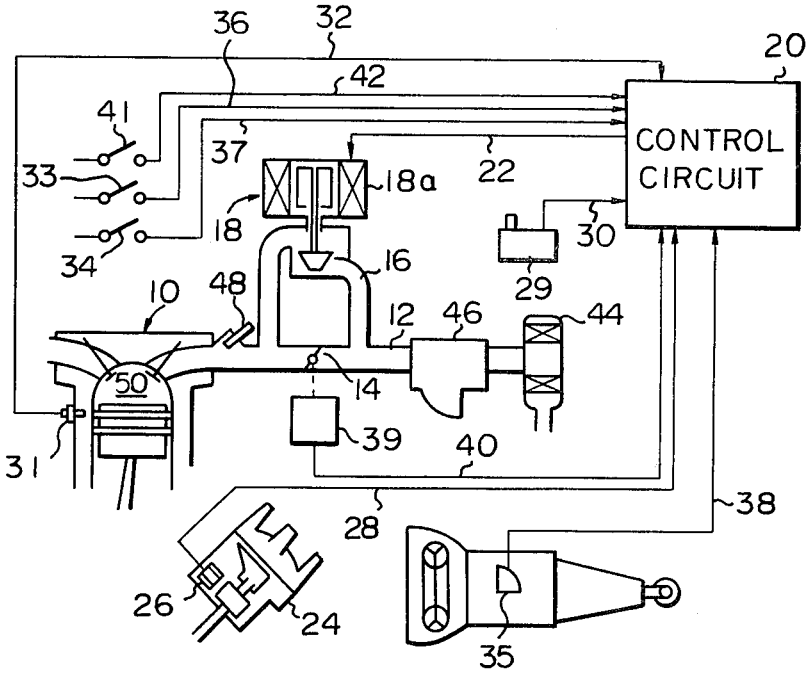
FIG. 1 is a schematic diagram illustrating a system according to the present invention.

Referring to FIG. 1, in which an example of an electronic fuel injection control system of an internal combustion engine according to the present invention is illustrated, reference numeral 10 denotes an engine body, and 12 denotes an intake passage. A throttle valve 14 is disposed in the intake passage 12. An electric air control valve (EACV) 18 is provided in an air bypass passage 16 which connects with the upstream side of the throttle valve 14 in the intake passage 12 and with the downstream side of the throttle valve 14 in the intake passage 12. The EACV 18 operates based on an electric current that is fed from a control circuit 20 to an exciting coil 18*a* via a line 22 and controls the flow rate of the air that flows through the air bypass passage 16.

A distributor 24 is provided with a crank angle sensor 26 which generates a pulse at every predetermined angle rotation of the crankshaft, for example, every time the crankshaft turns by the angle of 30°. The generated pulse is sent to the control circuit 20 via a line 28.

An atmospheric pressure sensor 29, which is an absolute pneumatic pressure sensor, detects the atmospheric pressure around the engine and generates an analog voltage corresponding to said absolute pressure or exhibits resistance which changes depending upon the absolute pressure. The detection voltage from the atmospheric pressure sensor 29 is fed to the control circuit 20 via a line 30.

A coolant temperature sensor 31 produces an analog voltage corresponding to the temperature of the coolant of the engine, and the produced voltage signal is sent to the control circuit 20 via a line 32.

The control circuit 20 further receives an A/C signal that indicates the air-conditioner is operating a PS signal that indicates the power-assisted steering is operating, and a shift position signal (T/M signal) that indicates the automatic transmission is shifted to the drive range (D range) or to a position corresponding thereto. These signals are sent from an air-conditioner switch 33, a power-assisted steering switch 34, and a shift position switch 35 via lines 36, 37 and 38, respectively. Further, a signal which represents whether the throttle valve 14 is at the idling position is sent to the control circuit 20 via a line 40 from a throttle position switch 39 that is coupled to the shaft of the throttle valve 14. A starting signal which indicates that the engine is cranking is sent from a starter switch 41 to the control circuit 20 via a line 42.

In electronic fuel injection control type internal combustion engines of this kind, as is well known, the flow rate of the air taken into the engine via an air cleaner 44 is detected by an air flow sensor 46. Fuel, in an amount which corresponds to the detected flow rate of the intake air, is injected from a fuel injection valve 48 to produce the gas mixture which is fed to a combustion chamber 50. Therefore, by controlling the flow rate of the bypass air through the air bypass passage 16 by the EACV 18 when the throttle valve 14 is at the idling position, one can control the idling speed of the engine according to the bypass air flow rate.

Figure 2:
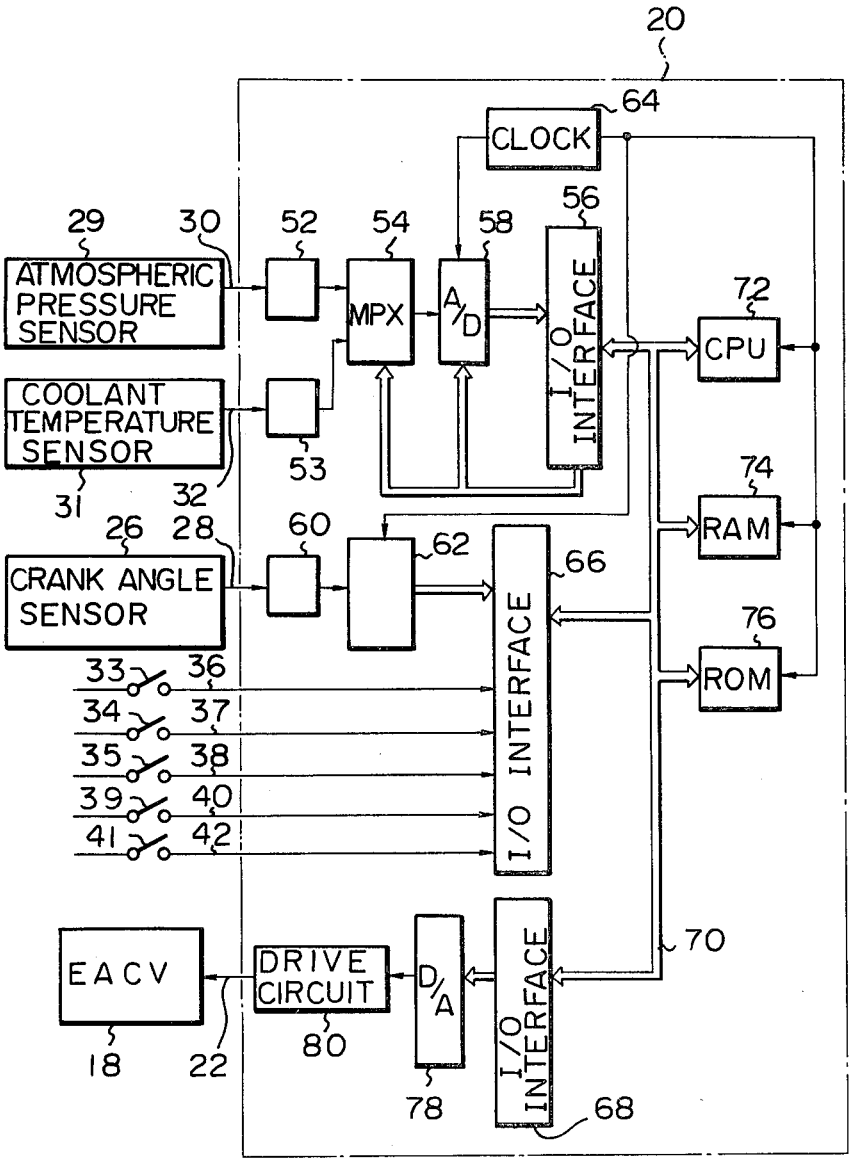
FIG. 2 is a block diagram illustrating a control circuit in the system of FIG. 1.

FIG. 2 is a block diagram which illustrates in detail the control circuit 20 of FIG. 1.

Voltage signals from the atmospheric pressure sensor 29 and the coolant temperature sensor 31 are sent to an analog multiplexer 54 via buffers 52 and 53, respectively. The analog multiplexer 54 further receives various other voltage signals which, however, are not mentioned here since they have no direct relation to the present invention. The voltage signals sent to the multiplexer 54 are fed to an A/D converter 58 in sequence responsive to selection signals from the input/output interface (I/O interface) 56, and converted into binary signals. The converted binary signals are fed to the I/O interface 56.

Pulses produced by the crank angle sensor 26 at every crank angle of 30° are fed to a speed signal generator circuit 62 via a buffer 60. The speed signal generator circuit 62 consists of a gate that is opened and closed by the pulse produced at every crank angle of 30°, and a counter which counts the number of clock pulses that pass through the gate and that are generated by a clock generator 64. The speed signal generator circuit 62 forms a binary speed signal having a value that represents the actual speed of the engine. The thus formed signal is fed to a predetermined bit position of an I/O interface 66. The signals from the air-conditioner switch (A/C switch) 33, power-assisted steering switch (PS switch) 34, shift position switch (T/M switch) 35, throttle switch 39, and starter switch 41 are sent to predetermined bit positions of the I/O interface 66.

The I/O interfaces 56, 66, and an I/O interface 68 that will be mentioned later, are connected via a bidirectional bus 70 to a central processing unit (CPU) 72, a random access memory (RAM) 74, and a read-only memory (ROM) 76 that are principal elements constituting a microcomputer. The data are transferred through the bus 70. The RAM 74 temporarily stores a variety of imput data, data that will be used in the calculation, and the results of the calculation. The ROM 76 stores a program for processing calculations that will be mentioned later, and various data necessary for processing the calculations.

The control output $D_{out}$ for the EACV 18 sent to the I/O interface 68 from the CPU 72 is applied to a D/A converter 78, and is converted to a drive signal having a voltage corresponding to the value $D_{out}$. The drive signal is converted, by a drive circuit 80, into a current having a value corresponding to the voltage thereof, and is sent to the EACV 18. Therefore, the EACV 18 is opened by an amount that corresponds to the current value and, hence, the flow rate of the air flowing through the air bypass passage assumes a value which corresponds to the control output $D_{out}$.

The data processed by the microcomputer are mentioned below. In executing the main processing routine, the CPU 72 introduces the newest data related to the speed $N_e$ of the engine from the I/O interface 66 and stores it in a predetermined region of the RAM 74. The RAM 74 further stores the data that represent the turned-on state or turned-off state of the A/C switch 33, PS switch 34, T/M switch 35, throttle switch 39, and starter switch 41, that are applied to other parts of the I/O interface 66. The RAM 74 further stores in the predetermined regions the newest data that represent the atmospheric pressure $P_a$ and the coolant temperature THW, which are fed to the I/O interface 56 in response to the routine for processing the A/D conversion interrupt that is executed at every predetermined period of time.

Figure 3:
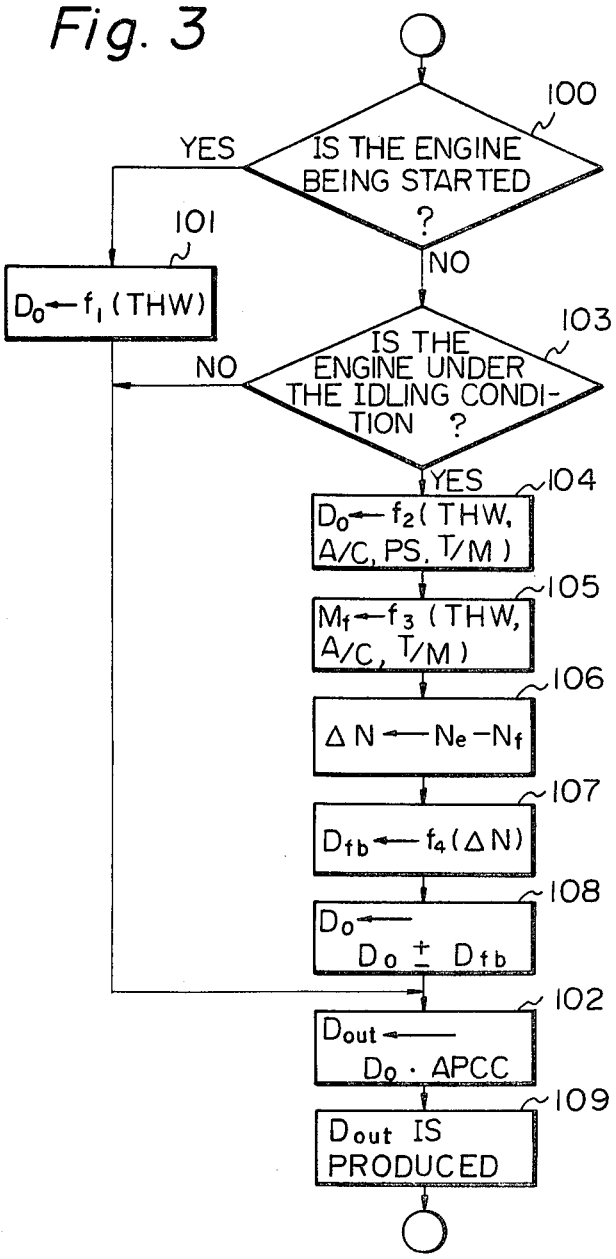
FIGS. 3 and 4 are flow diagrams illustrating the operations of the digital computer in the control circuit of FIG. 2.

FIG. 3 illustrates a program for calculating the control output $D_{out}$ that is used for controlling the EACV 18.

The CPU 72 executes the processing routine of FIG. 3 responsive to the interrupt requested at every predetermined period of time or during the main processing routine. First, at a point 100, the CPU 72 detects whether the starter switch 41 is turned on to discriminate whether the engine is being started (cranking). When the engine is cranking, the program proceeds to a point 101 where a fundamental value $D_o$ of control output is found as a function of the coolant temperature THW of the engine, i.e., $D_o=f_1(THW)$. The program then proceeds to a point 102.

When the engine is not cranking, the CPU 72 executes the processing of a point 103. That is, at the point 103, the CPU 72 detects whether the throttle switch 39 is turned on to discriminate whether the engine is under the idling condition. When the engine is not under the idling condition, the program proceeds to the point 102. Therefore, in this case, the idling speed is not controlled by feedback, but is controlled by open-loop. When the engine is under the idling condition, the program proceeds to a point 104 where the fundamental value $D_o$ of the control output is calculated according to the coolant temperature THW of the engine, the A/C signal, PS signal, and T/M signal. Namely, the calculation of $D_o=f_2(THW, A/C, PS, T/M)$ is carried out. At a point 105, the CPU 72 calculates the desired idling speed $N_f$ depending upon the coolant temperature THW, A/C signal, and T/M signal. At a point 106, the CPU 72 finds the difference $\Delta N$ between the desired idling speed $N_f$ and the actual idling speed $N_e$ of the engine, and, at a next point 107, finds a feedback quantity $D_{fb}$ from the difference $\Delta N$. That is, at the point 106, the CPU 72 performs the calculation of $\Delta N=N_e-N_f$ and, at the point 107, performs the calculation of $D_{fb}=f_4(\Delta N)$. At a point 108, the fundamental value $D_o$ of the control output is corrected by the feedback quantit $D_{fb}$, i.e., $D_o \leftarrow D_o \pm D_{fb}$.

At the point 102, the fundamental value $D_o$ is corrected by an atmospheric pressure correction coefficient APCC, that is found by a processing routine which will be mentioned later and that is stored in a predetermined region of the RAM 74, in order to find the control output $D_{out}$. That is, at the point 102, the CPU 72 executes the operation of $D_{out}=D_o$. APCC at a point 109, the thus found control output $D_{out}$ is fed to the I/O interface 68.

The points except the point 102 in the above-mentioned processing routine all pertain to the prior art as has been disclosed in detail, for example, in the specification of U.S. patent application Ser. No. 303,107.

Figure 4:
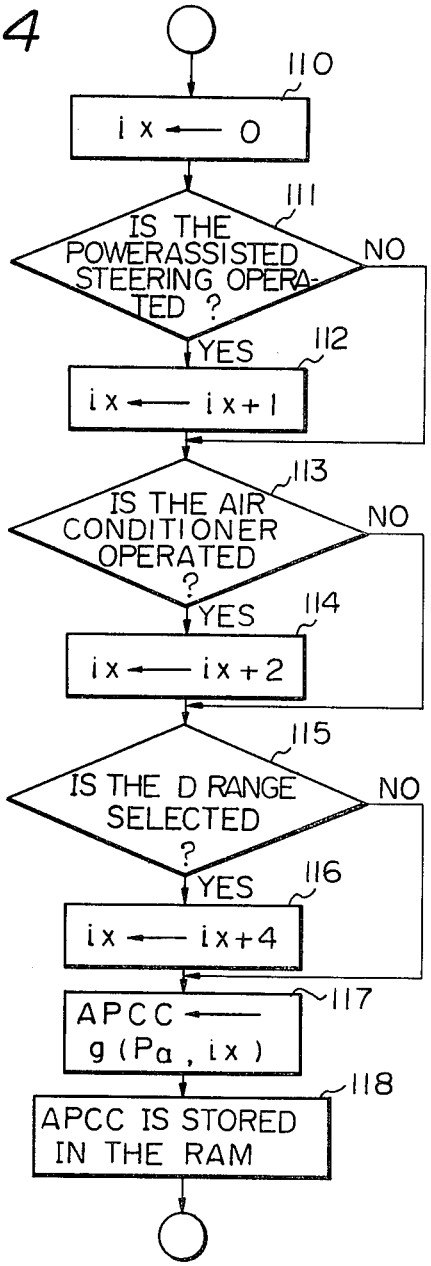

The method of calculation of the atmospheric pressure correction coefficient APCC is mentioned below. FIG. 4 illustrates a program for executing this calculation. Namely, the CPU 72 executes the processing routine of FIG. 4 during the main processing routine or responsive to the interrupt requested at every predetermined period of time. First, at a point 110, the CPU 72 initializes an index ix for searching the map, i.e., ix←0. At a point 111, it examines the PS signal. When the power-assisted steering is operating, the program proceeds to a point 112 where the index ix is increased by one. That is, at the point 112, the CPU 72 executes the processing of ix←ix+1. The program then proceeds to a point 113. When the power-assisted steering is not operating, the program proceeds to the point 113 without increasing the index ix. At the point 113, the CPU 72 examines the A/C signal. When the air-conditioner is in operation, the program proceeds to a point 114 where the index ix is increased by two. That is, at the point 114, the CPU 72 executes the processing of ix←ix+2. The program then proceeds to a point 115. When the air-conditioner is not operating, the program proceeds to the point 115 without increasing the index ix. At the point 115, the CPU 72 examines the T/M signal. When the automatic transmission gear is shifted to the D range or a similar range, the program proceeds to a point 116 where the index ix is increased by four. That is, at the point 116, the CPU 72 executes the processing ix←ix+4. The program then proceeds to a point 117. When the transmission gear is shifted to the neutral range (N range) or to the parking range, the program proceeds to the point 117 without increasing the index ix.

Figure 5:
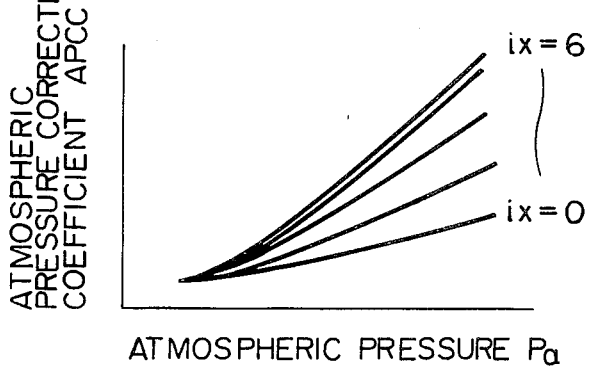
FIG. 5 is a graph illustrating relationships between the atmospheric pressure $P_a$ and the atmospheric pressure correction coefficient APCC.

At the point 117, the CPU 72 calculates the atmospheric pressure correction coefficient APCC by the mapping method relying upon the detected atmospheric pressure $P_a$ and the index ix that is found by the above-mentioned processing. Namely, in the ROM 76 has been stored a function $g(P_a, ix)$ of the atmospheric pressure correction coefficient APCC in the form of a map as shown in FIG. 5, with the index ix as a parameter and the atmospheric pressure $P_a$ as a variable. By using the map, the CPU 72 calculates the atmospheric pressure correction coefficient APCC from the atmospheric pressure $P_a$ and the index ix. The obtained coefficient APCC is tored in a predetermined region of the RAM 74 at a point 118.

The control output $D_{out}$ is corrected (point 102 of FIG. 3) by the atmospheric pressure correction coefficient APCC that is found through the processing routine of FIG. 4. Therefore, the flow rate of the air taken into the engine when it is under the idling condition is controlled depending upon the atmospheric pressure. In other words, the idling speed can be stably controlled even when the engine is operated at high altitudes. Further, since the atmospheric pressure correction coefficient APCC is increased or decreased based on the change in the load by the air-conditioner, power-assisted steering, transmission gear, and the like, the idling speed of the engine can be stably controlled without causing engine stalling even at high altitudes.

The routine for processing the control output need not be limited to the one illustrated in FIG. 3, but may take any form provided the finally obtained control output $D_{out}$ is corrected by the atmospheric pressure correction coefficient APCC (or provided the processing corresponding to the point 102 of FIG. 3 is executed).

According to the present invention as described in detail in the foregoing, the flow rate of the air that flows through the air bypass passage is controlled depending upon the atmospheric pressure and, hence, the idling speed of the engine can be stably controlled even at high altitudes. In this case, if the flow rate of the air is further controlled based on the load exerted on the engine, the engine will not stall eveh when the load is exerted on the engine at high altitudes. In effect, the idling speed of the engine can be controlled more stably.

As many widely different embodiments of the present invention may be constructed without departing from the spirit and scope of the present invention, it should be understood that the present invention is not limited to the specific embodiments described in this specification, except as defined in the appended claims.

I claim:

1. A method for controlling the idling speed of an internal combustion engine having an intake passage, a throttle valve disposed in the intake passage, and an air bypass passage which is connected with the intake passage at a position located upstream of the throttle valve and with the intake passage at a position located downstream of the throttle valve, said method comprising the steps of:

detecting the actual idling speed of the engine to produce a first electrical signal corresponding to said speed;

detecting the atmospheric pressure surrounding the engine to produce a second electrical signal which indicates said pressure;

calculating, based on the first electrical signal, the difference between the actual idling speed of the engine and the desired idling speed;

calculating the value of a control output signal from said calculated difference;

determining, in response to said second electrical signal, an atmospheric pressure correction coefficient by using one of continuous functions which indicate relationships between the atmospheric pressure and the atmospheric pressure correction coefficient;

correcting the calculated value of the control output signal in accordance with said determined atmospheric pressure correction coefficient; and adjusting, based on the control output signal, the flow rate of air passing through the air bypass passage to control the actual idling speed of the engine to bring it close to the desired idling speed.

2. A method as claimed in claim 1, wherein said method further comprises a step of detecting the change in the amount of load applied to the engine to produce at least one additional electrical signal corresponding to said change and wherein said determining step includes a step of determining, in response to said second and additional electrical signals, an atmospheric pressure correction coefficient by using of continuous functions which indicate relationships between the atmospheric pressure, the engine load, and the atmospheric pressure correction coefficient.

3. A method as claimed in claim 2, wherein said step of detecting the change in the amount of load includes a step of detecting whether a predetermined load is applied to the engine.

4. A method as claimed in claim 3, wherein said predetermined load is power-assisted steering.

5. A method as claimed in claim 3, wherein said predetermined load is an air-conditioner.

6. A method as claimed in claim 3, wherein said predetermined load is a drive-range gear of an automatic transmission.

7. An apparatus for controlling the idling speed of an internal combustion engine having an intake passage, a throttle valve disposed in the intake passage, and an air bypass passage which is connected with the intake passage at a position located upstream of the throttle valve and with the intake passage at a position located downstream of the throttle valve, said apparatus comprising:

means for detecting the actual idling speed of the engine to produce a first electrical signal corresponding to said speed;

means for detecting the atmospheric pressure surrounding the engine to produce a second electrical signal which indicates said pressure;

processing means for (1) calculating, based on the first electrical signal, the difference between the actual idling speed of the engine and the desired idling speed, (2) calculating the value of a control output signal from said calculated difference, (3) determining, in response to said second electrical signal, an atmospheric pressure correction coefficient by using one of continuous functions which indicate relationships between the atmospheric pressure and the atmospheric pressure correction coefficient, and (4) correcting the calculated value of the control output signal in accordance with said determined atmospheric pressure correction coefficient; and means for adjusting, based on the control output signal, the flow rate of air passing through the air bypass to control the actual idling speed of the engine to bring it close to the desired idling speed.

8. An apparatus as claimed in claim 7, wherein said apparatus further comprises means for detecting the change in the amount of load applied to the engine to produce at least one additional electrical signal corresponding to said change and wherein said processing means determines, in response to said second and additional electrical signals, an atmospheric pressure correction coefficient by using one of continuous functions which indicate relationships between the atmospheric pressure, the engine load, and the atmospheric pressure correction coefficient.

9. An apparatus as claimed in claim 8, wherein said means for detecting the change in the amount of load includes means for detecting whether a predetermined load is applied to the engine.

10. An apparatus as claimed in claim 9, wherein said predetermined load is power-assisted steering.

11. An apparatus as claimed in claim 9, wherein said predetermined load is an air-conditioner.

12. An apparatus as claimed in claim 9, wherein said predetermined load is a drive-range gear of an automatic transmission.

* * * * *